US005736999A

United States Patent [19]

Aoki

[11] Patent Number: 5,736,999

[45] Date of Patent: Apr. 7, 1998

[54] LASER PROCESSING METHOD TO FORM AN INK JET NOZZLE PLATE

[75] Inventor: Hikoharu Aoki, Nagoya, Japan

[73] Assignee: Brother Kogyo Kabushiki Kaisha, Nagoya, Japan

[21] Appl. No.: 507,669

[22] Filed: Jul. 25, 1995

[30] Foreign Application Priority Data

Sep. 7, 1994 [JP] Japan ..... 6-240640

[51] Int. Cl.[6] ..... B41J 2/16

[52] U.S. Cl. ..... 347/47; 347/262

[58] Field of Search ..... 347/262, 264, 347/256, 40, 47

[56] References Cited

U.S. PATENT DOCUMENTS 5,157,091 10/1992 Masataka et al. ..... 526/245

5,208,604 5/1993 Watanabe et al. .

FOREIGN PATENT DOCUMENTS 4-9291 1/1992 Japan .

OTHER PUBLICATIONS

"Ultraviolet Laser Ablation of Organic Polymers", R. Srinivsan et al., Chemical Reviews 1989, vol. 89, No. 6, pp. 1303–1316.

Laser Thermal Processing Research Institute Documentation, 1990, No. 23., pp. 141–157.

*Primary Examiner*—Mark J. Reinhart

*Attorney, Agent, or Firm*—Oliff & Berridge, PLC

[57] ABSTRACT

A laser processing method irradiates an excimer laser beam at a surface of an object composed of a polymer material that absorbs the excimer laser beam. The polymeric object is substantially free of lubricants that reflect wavelengths within the range of operation of the excimer laser beam. The invention also relates to a nozzle plate of an ink jet device, which does not contain such lubricants, produced with an excimer laser beam.

19 Claims, 3 Drawing Sheets

LASER PROCESSING METHOD TO FORM AN INK JET NOZZLE PLATE

BACKGROUND OF THE INVENTION

1. Field of the Invention

The present invention relates to a laser processing method which conducts processing by irradiating an excimer laser beam at an object.

2. Description of the Related Art

Conventionally, the use of an excimer laser beam in processing is proposed in Japanese Unexamined Patent Publication No. 4-9291, which describes the method of processing by irradiating an excimer laser beam at a sheet composed of polymer materials such as polyimide or polysulfone.

In the field of ink jet printers, it is known to form a nozzle plate of the ink jet device by forming orifices in the nozzle plate material using a laser. See for example U.S. Pat. No. 5,208,604, which is totally incorporated herein by reference, which proposes a method of fabricating a nozzle plate for an ink jet printer comprising steps of forming a water-repellent film over the surface of a plate and forming a discharge hole through both the plate and the water-repellent film with an excimer laser beam or the like. The plate material may be made of a polyimide material such as SE-320 manufactured by Tokyo Ohka Kogyo Co., Ltd.

Processing of a polymeric workpiece with an excimer laser beam is a laser ablation process. According to Chemical Reviews, vol. 89, no. 6, pgs. 1303–1316 (1989), incorporated herein by reference, the mechanism of ablation has three steps as seen in FIG. 3 of the reference. A polymeric workpiece absorbs an excimer laser beam transmitted through a mask, high molecules of the polymeric workpiece are disintegrated, and the molecules are decomposed and atoms are scattered in the process.

In general, $SiO_2$ or similar materials have been added as a lubricant to polymer materials which form the object, for example a nozzle plate for an ink jet device, to be treated by an excimer laser beam. Manufacturers conventionally add lubricants to such polymer materials because many end uses of the polymeric plates require slipping of the surfaces. For example, the polymeric plates are also used in the formation of flexible circuit plates which in use are stacked on top of each other, requiring that the surfaces have slipperiness to avoid scratching and breaking. Other uses for such polymer plates, such as insulation materials, are not adversely affected by the presence of lubricants, so that manufacturers find it efficient to include lubricants in all polymer plate materials because of the ease of having one manufacturing process.

However, within the ultraviolet ray region, which is the region of excimer laser beam wavelengths, Si has a high reflectivity for excimer laser beams (Laser Thermal Processing Research Institute documentation, 1990, No. 23). Consequently, the problem arises that when particles of Si are at the location being processed, the shape to be formed in the polymer plate during processing becomes poor, as shown in FIG. 3.

SUMMARY OF THE INVENTION

The present invention was designed in order to resolve the above and other problems, and it is an object of the present invention to provide a laser processing method which results in a favorable shape.

In order to achieve the above and other objects, the invention is a laser processing method, wherein processing is conducted by irradiating an excimer laser beam. The method comprises irradiating an excimer laser beam at an object composed of a polymer material that absorbs the excimer laser beam, while excluding from the object a highly reflective lubricant that makes the surface slippery.

In a preferred embodiment, the excluded lubricant is a silicon oxide or silicon oxide compound. In another preferred embodiment, the irradiated object is the nozzle plate of an ink jet device which composes images by jetting ink from a nozzle.

With the laser processing method of the present invention, having the above-described configuration, the irradiated object can be processed into a favorable shape by irradiating an excimer laser beam at the object which is composed of a polymer material that absorbs the excimer laser beam, while not containing a highly reflective lubricant that makes the surface slippery.

BRIEF DESCRIPTION OF THE DRAWINGS

A preferred embodiment of the present invention is described with reference to the following drawings in which.

DETAILED DESCRIPTION OF PREFERRED EMBODIMENTS

Figure 1:
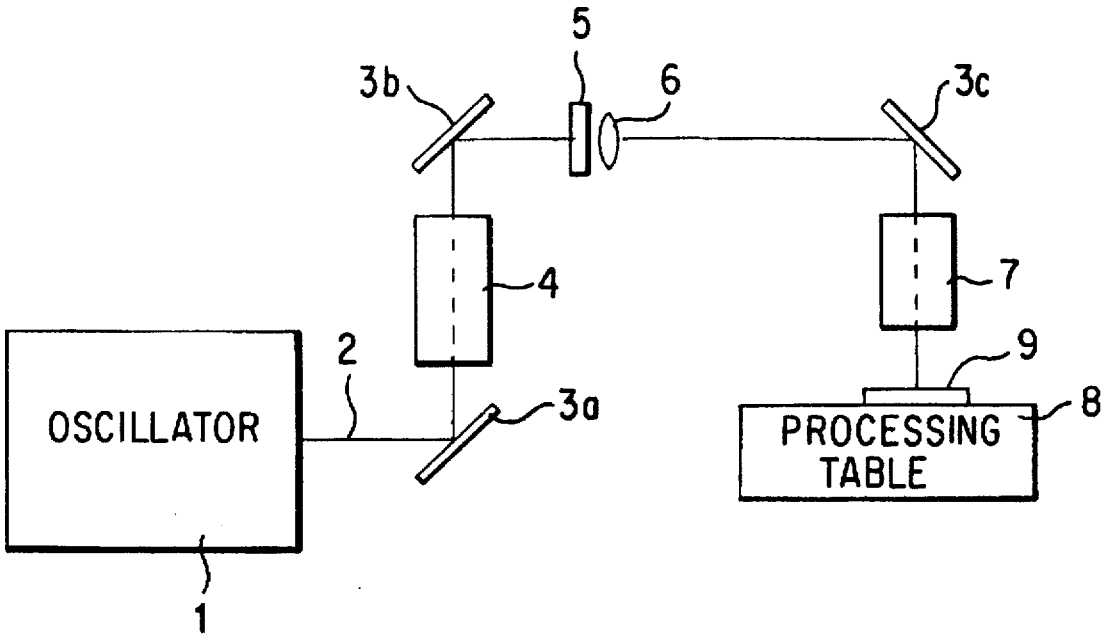
FIG. 1 is a configuration drawing showing the laser processing device of an embodiment of the present invention.

FIG. 1 is a drawing showing the configuration of a complete laser processing device. With the laser processing device of the present embodiment, an excimer laser beam 2 emitted from an oscillator 1 forms an optical path that reaches the processing table 8 via mirrors 3*a*, 3*b* and 3*c*. A beam expander 4 which enlarges the excimer laser beam 2 to the desired size is provided on the optical path between mirror 3*a* and mirror 3*b*. An aperture member (unrepresented) which cuts off excess portions of the beam is provided on the side of this beam expander from which the laser beam is incident. Between mirror 3*b* and mirror 3*c* is provided a mask 5 in order to confer the shape corresponding to the hole that is to be made by the excimer laser beam 2. In addition, following the mask 5 is a field lens 6 used to guide the mask image, which has passed through the mask 5, to the imaging optical system 7. This imaging optical system 7 is provided between mirror 3*c* and the processing table 8, and is a system used to restrict the excimer laser beam 2 which has passed through the mask 5 to the desired size on the object 9 of processing, which is placed on the processing table 8.

Lubricants that are to be excluded from the present invention are those lubricants that have high reflectivities for excimer laser beams, i.e., reflect ultraviolet ray wavelengths of 10 to 400 nm, particularly 50 to 300 nm. Examples include, without limitation, silicon oxides such as $SiO_2$ and silicon oxide compounds, calcium hydrogenphosphate and calcium hydrogencarbonate. In a preferred embodiment, the silicon oxide lubricant is excluded. Lubricants that do not reflect wavelengths within the range of operation of excimer laser beams may be present in the polymer object to be irradiated, if desired.

The wavelength of reflectivity of a lubricant can be determined in a simple, conventionally known manner. The method of the present invention includes determining the wavelength of reflectivity of a desired lubricant, and selecting polymer materials, which are to form the sheet to be irradiated with the excimer laser beam, which are free of or substantially free of the lubricant if it reflects wavelengths within the range of operation of the excimer laser beam, i.e., within the range of 10 to 400 nm.

In a preferred embodiment, the irradiated object is the nozzle plate of an ink jet device which composes images by jetting ink from a nozzle.

The object 9 to be processed is a polyimide sheet which does not include $SiO_2$ particles that would make the surface more slippery. The thickness of this sheet is 100 μm. With the present invention, 60 nozzles that jet ink are made in a single row on the object 9. The intake diameter of the nozzles is 80 μm, while the jet spray diameter is 40 μm. The pattern diameter of the mask 5 is 400 μm, so that the process compression ratio is one-fifth. The excimer laser beam 2 used in the present embodiment is a KrF excimer laser beam with a wavelength of 248 nm.

Figure 2:
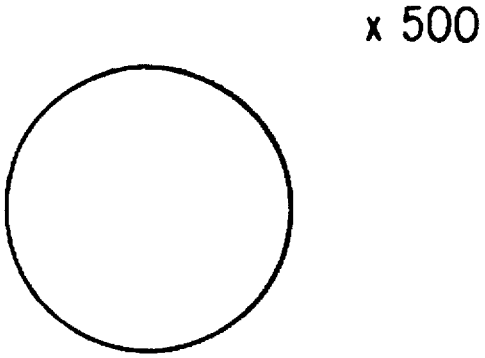
FIG. 2 is a drawing showing a photograph of the shape of a nozzle that has been processed by the above-described embodiment.

The shape of a nozzle that has been processed by an excimer laser beam according to the above described process, conditions and materials on the polyimide sheet containing no $SiO_2$ particles is shown in FIG. 2. As is clear from FIG. 2, the shape of the nozzle is an extremely smooth circle. Accordingly, the precision of the dimensions of the nozzle is good, so that there is no dispersion in the direction of flight of ink droplets. Printing quality is very good with an ink jetting device that uses this nozzle.

Figure 3:
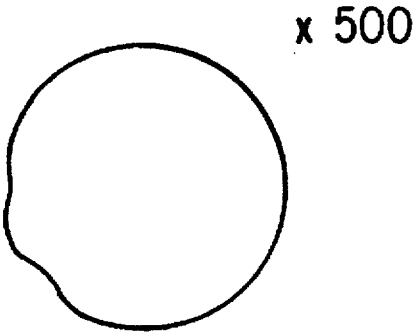
FIG. 3 is a drawing showing a photograph of the shape of a nozzle that has been processed using a conventional type of method.

The shape of a nozzle that has been processed by an excimer laser beam identically to the process, conditions and materials used in producing the nozzle shown in FIG. 2, with the exception that the polyimide sheet contains 1500 ppm $SiO_2$, is shown in FIG. 3. As can be seen in FIG. 3, the presence of the $SiO_2$ lubricant resulted in a poor shape for the nozzle formed by the excimer laser.

As is clear from the above explanation, with the laser processing method of the present invention, an excimer laser beam is irradiated at an object to be processed which is composed of a polymer material that absorbs the excimer laser beam, while not containing a lubricant that makes the surface slippery. Consequently, it is possible for the excimer laser beam to be absorbed well by the object of processing without reflection, so that the result is a favorable shape.

While a polyimide sheet is described in the present embodiment, other preferred polymer materials can also be used, such as for example polysulfone, polyether sulfone, polyphenylene oxide or polypropylene. Other polymer materials that are processable by an excimer laser include polyesters, epoxies, polycarbonates and polyurethanes, although these materials are less preferred as nozzle plates in ink jet devices.

Figure 4:
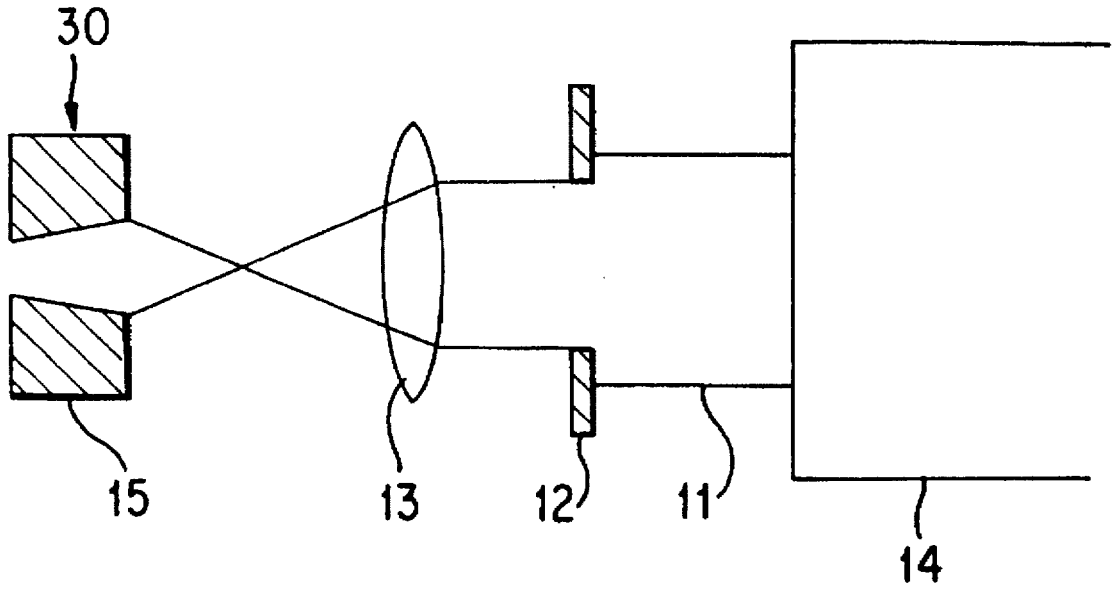
FIG. 4 is a diagrammatic schematic view in partial section of a nozzle plate processing device.

FIG. 4 shows another apparatus for forming a nozzle of an ink jet device using an excimer laser. An excimer laser beam 11 emitted by an excimer laser 14 is projected through a mask 12 having an aperture similar to a desired shape in which the nozzle orifice is to be formed toward the polymer plate 15 of the nozzle plate 30. The excimer laser beam 11 is focused on the polymer plate 15 for laser machining. The excimer laser is preferably a KrF excimer laser that emits an excimer laser beam of 248 nm in wavelength. The mask 12 and lens 13 are designed properly taking into consideration the shape of the nozzle orifice and laser machining conditions. The lens 13 is preferably a reducing lens having a reduction ratio of ⅕, for example.

The present invention is not limited to the above-described embodiments, for various changes may be made without departing from the spirit and scope of the invention. For example, the thickness of the object 9 is not limited to 100 μm, but can range for example from 1 to 1,000 μm, preferably 5 to 200 μm, most preferably 50 to 100 μm. Furthermore, the shape of the nozzle is not limited to a circle, but also may be an ellipse or a rectangle.

In addition, the excimer laser beam 2 in the present embodiment was a KrF excimer laser beam, but the excimer laser beam could be an ArF excimer laser beam or a XeCl excimer laser beam or the like.

What is claimed is:

1. A laser processing method for forming a nozzle plate of an ink jet device, comprising selecting a nozzle plate polymer sheet that absorbs an excimer laser beam and is substantially free of lubricants that reflect ultraviolet ray wavelengths of 50 to 300 nm, and irradiating an excimer laser beam at a surface of the nozzle plate polymer sheet so as to form one or more nozzle orifices in the nozzle plate polymer sheet.

2. The method of claim 1, wherein the polymer sheet is substantially free of a silicon oxide compound lubricant.

3. The method of claim 1, wherein the polymer sheet is substantially free of a lubricant selected from the group consisting of silicon oxide, calcium hydrogenphosphate and calcium hydrogencarbonate.

4. The method of claim 1, wherein the polymer sheet is substantially free of a lubricant that reflects ultraviolet ray wavelengths of 10 to 400 nm.

5. A laser processing method, comprising determining the wavelength reflectivity range of a lubricant, selecting a polymer material that absorbs an excimer laser beam and that is substantially free of lubricants that reflect wavelengths of 50 to 300 nm, and irradiating an excimer laser beam at a surface of an object composed of the polymer material.

6. The method of claim 5, wherein said polymer material is substantially free of lubricants that reflect wavelengths of 10 to 400 nm.

7. The method of claim 6, wherein the object is a nozzle plate of an ink jet device.

8. The method of claim 1, wherein said excimer laser beam is a KrF, ArF or XeCl laser beam.

9. The method of claim 8, wherein said excimer laser beam is a KrF laser beam.

10. A nozzle plate of an ink jet device, said nozzle plate comprising a polymer sheet having a thickness of from 5 to 200 μm and substantially free of $SiO_2$lubricant, said nozzle plate containing one or more nozzle orifices formed by a process comprising irradiating an excimer laser beam at a surface of said polymer sheet which absorbs the excimer laser beam to form said one or more nozzle orifices.

11. A nozzle plate according to claim 10, wherein said polymer sheet is a sheet selected from the group consisting of polyimide, polysulfone, polyether sulfone, polyphenylene oxide, polypropylene, polyester, epoxy, polycarbonate and polyurethane.

12. A nozzle plate according to claim 11, wherein said polymer sheet is a sheet of polyimide.

13. A nozzle plate according to claim 10, wherein said polymer sheet is substantially free of a silicon oxide compound lubricant.

14. A nozzle plate according to claim 13, wherein the polymer sheet is substantially free of a lubricant selected from the group consisting of silicon oxide, calcium hydrogenphosphate and calcium hydrogencarbonate.

15. A nozzle plate according to claim 14, wherein the polymer sheet is substantially free of a lubricant that reflects ultraviolet ray wavelengths of 50 to 300 nm.

16. A nozzle plate according to claim 10, wherein the polymer sheet is substantially free of a lubricant that reflects ultraviolet ray wavelengths of 50 to 300 nm.

17. A nozzle plate according to claim 16, wherein the polymer sheet is substantially free of a lubricant that reflects ultraviolet ray wavelengths of 10 to 400 nm.

18. A nozzle plate according to claim 10, wherein the thickness of said polymer sheet is from 50 to 100 μm.

19. A nozzle plate according to claim 10, wherein the thickness of said polymer sheet is from 50 to 200 μm.

* * * * *